US007365259B2

(12) United States Patent
Nishida

(10) Patent No.: US 7,365,259 B2
(45) Date of Patent: Apr. 29, 2008

(54) KEYBOARD APPARATUS

(75) Inventor: Kenichi Nishida, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/489,990

(22) Filed: Jul. 19, 2006

(65) Prior Publication Data

US 2007/0017356 A1 Jan. 25, 2007

(30) Foreign Application Priority Data

Jul. 21, 2005 (JP) ..... 2005-211760

(51) Int. Cl.
*G10C 3/12* (2006.01)

(52) U.S. Cl. ..... 84/423 R

(58) Field of Classification Search ..... 84/423 R, 84/477, 478, 430–438, 441, 423 A
See application file for complete search history.

(56) References Cited

U.S. PATENT DOCUMENTS 4,476,769 A * 10/1984 Kumano ..... 84/434
5,834,668 A * 11/1998 Kumano et al. ..... 84/423 R

* cited by examiner

*Primary Examiner*—Kimberly Lockett
(74) *Attorney, Agent, or Firm*—Morrison & Foerster LLP

(57) ABSTRACT

A keyboard apparatus is including a plurality of keys and a plurality of mass members provided under the respective keys to be pivotably supported on a keyboard frame being a support member, each of the mass members extends along a longitudinal direction of the key and has a mass concentration part in its rear end portion, and when not driven by a mass driving part of the key, each of the mass members is in an inclined state with the mass concentration part being at the lowest descended position. The keyboard frame has a rib provided between two adjacent mass members among the plural mass members, and at least part of a lower edge of the rib is formed along lower edges of the mass members in the inclined state.

7 Claims, 10 Drawing Sheets

KEYBOARD APPARATUS

BACKGROUND OF THE INVENTION

1. Field of the Invention

The invention relates to a keyboard apparatus used in electronic keyboard instruments such as an electronic organ, an electronic piano, and a synthesizer, or in electric keyboard instruments.

2. Description of the Related Art

Some of conventional keyboard apparatuses used in electronic keyboard instruments such as electronic organs and electronic pianos also include mass members generally called hammers in correspondence to respective keys, so as to provide a heavy touch feeling close to a key touch feeling of an acoustic musical instrument such as a piano. The hammers pivot in linkage with a key depression operation of the respective keys to give a force depending on their movement as a reactive force against a key depression force, thereby providing a desired key depression touch feeling.

For example, a keyboard apparatus disclosed in U.S. Pat. No. 5,834,668 B is structured such that keys and mass members extending under the keys along a key longitudinal direction are pivotably supported on a keyboard frame being a support member, and when the keys are depressed, the mass members are driven to pivot by force transmitting parts provided under the keys, and inertia moment generating parts in a metal bar-shape thereof are lifted with a large stroke to provide a heavy key touch feeling. When the keys are released, the mass members pivot in a reverse direction and the inertia moment generating parts return to a descended position.

In order to allow the inertia moment generating parts of the mass members to thus move up/down with a large stroke at the time of key depression/release, it is necessary for the support member to have a large space under the keys.

Further, in a case where the support member is formed of resin, ribs are formed for coupling support parts and reinforcing the whole support member. The ribs are arranged at intervals in an arrangement direction of the keys and the mass members to extend in parallel to the longitudinal direction of the keys and the mass members, and these ribs are provided also in the vicinity of a lower end of the support member.

Therefore, the space under the keys cannot be used effectively and in particular, does not allow long functional components and so on in the arrangement direction of the keys and the mass members (key width direction) to be disposed.

SUMMARY OF THE INVENTION

The invention was made to solve such problems, and an object thereof is to provide a keyboard apparatus including mass members corresponding to respective keys, in which a space formed under keys in a support member supporting the keys and the mass members can be effectively used without interfering with the ascending/descending movement of inertia moment generating parts when the mass members pivot.

The invention is a keyboard apparatus including: a support member; a plurality of keys pivotably supported on the support member; and a plurality of mass members provided under the respective keys to be pivotably supported on the support member via pivotal fulcrum parts and driven to pivot via mass member driving parts provided under the plural keys respectively, and the following structure is adopted in order to attain the above object.

The plural mass members extend along a longitudinal direction of the keys, having mass concentration parts in rear end portions thereof, and are mounted on the support member in such a manner that, when not driven, the mass members are in an inclined state with the mass concentration parts being at a lowest descended position.

The support member has a rib provided between predetermined two adjacent mass members among the plural mass members and at least part of a lower edge of the rib is formed along lower edges of the mass members that are not driven and are in the inclined state.

Another possible structure is such that the pivotal fulcrum parts of the mass members are provided at a predetermined height position from a lowest end of the support member, whereby a space outside a movement range of the mass members is formed under the mass members, and an uppermost portion of the space coincides with the part of the lower edge of the rib.

A printed circuit board or a speaker can be disposed in the space outside the movement range of the mass members.

Alternatively, a lower case is mounted on the lowest end of the support member, the lower case has an recessed portion recessed into the space, and the recessed portion serves as a functional component housing part.

The recessed portion can also serve as a battery housing part storing batteries or a battery pack, and a cover may be detachably attached to the lower case to cover the recessed portion.

The recessed portion is also allowed to be used as an accessories housing part where it stores accessories such as a code or a microphone.

In the keyboard apparatus according to the invention, the space formed under the keys in the support member supporting the keys and the mass members can be effectively used without interfering with the ascending/descending movement of the inertia moment generating parts when the mass members pivot. For example, in a case of a portable electronic keyboard instrument, it is possible to store batteries or a battery pack or accessories such as cords and microphones which are necessary, without providing an extra space, that is, without increasing a dimension in a height direction of the keyboard apparatus.

Moreover, as the functional components, for example, a printed circuit board constituting an electronic circuit such as an amplifier, speakers and so on, or bending-preventive rigidity generating members for increasing rigidity in the key arrangement direction of the keyboard apparatus (ribs, reinforcing members, and the like extending in the key arrangement direction) can be disposed under the lower edges of the ribs, that is, in the space under the mass members. Further, in a case where the lower case is provided, a temporary support member can be inserted in the recessed portion of the lower case to temporarily support the keyboard frame on the lower case when the support member (keyboard frame) and the lower case are assembled.

Incidentally, if only two or three dispersed places of a bottom face of the support member constitute the lowest end of the support member, the keyboard apparatus does not wobble and can be placed on a key bed of a keyboard instrument stably in a case where the keyboard apparatus is directly mounted on the key bed without having the lower case.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, the best mode for carrying out the invention will be concretely described based on the drawings.

Figure 1:
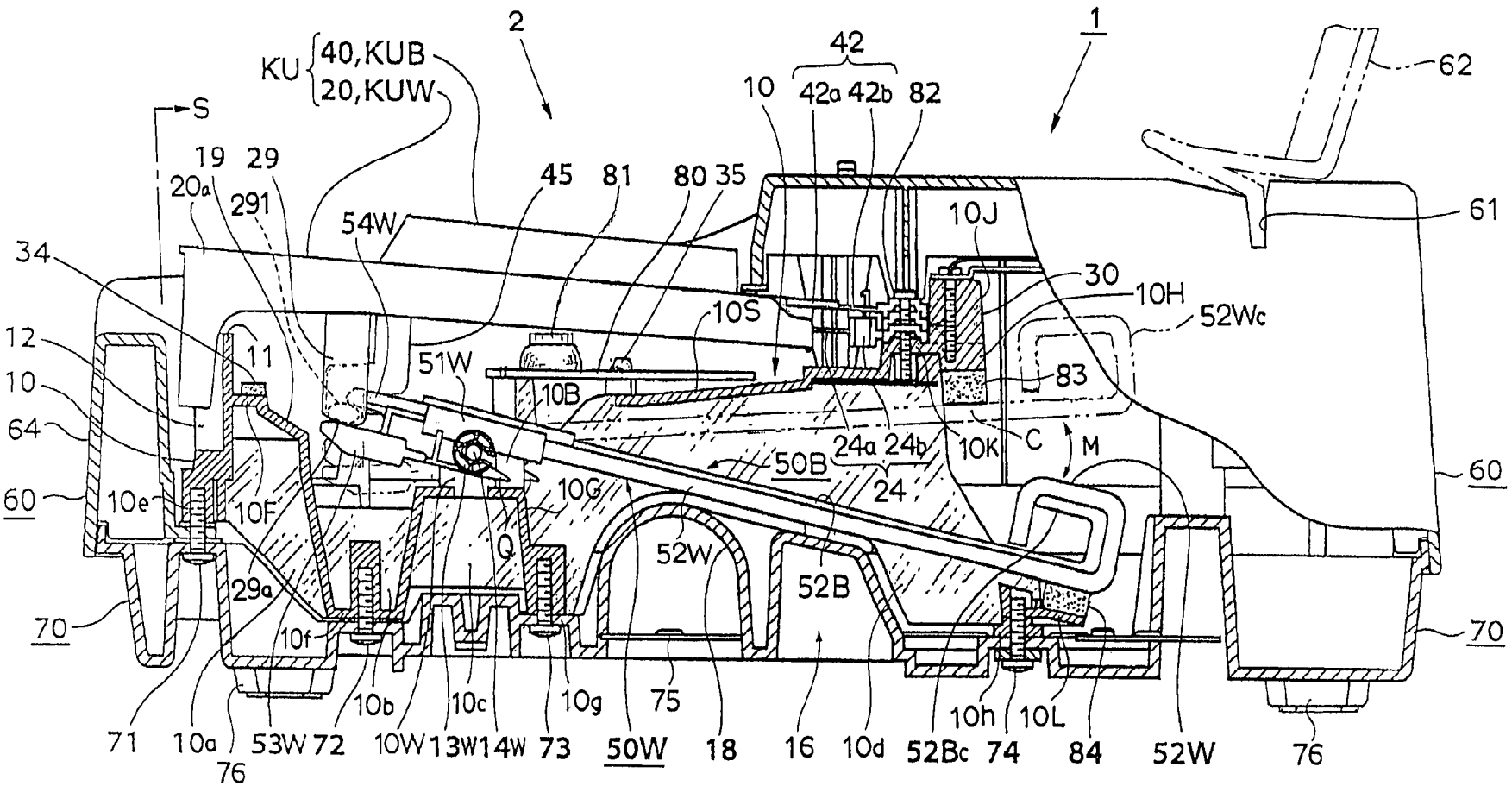
FIG. 1 is a rough cross-sectional view taken along a key longitudinal direction of an electronic musical instrument including a keyboard apparatus being one embodiment of the invention.
Figure 2:
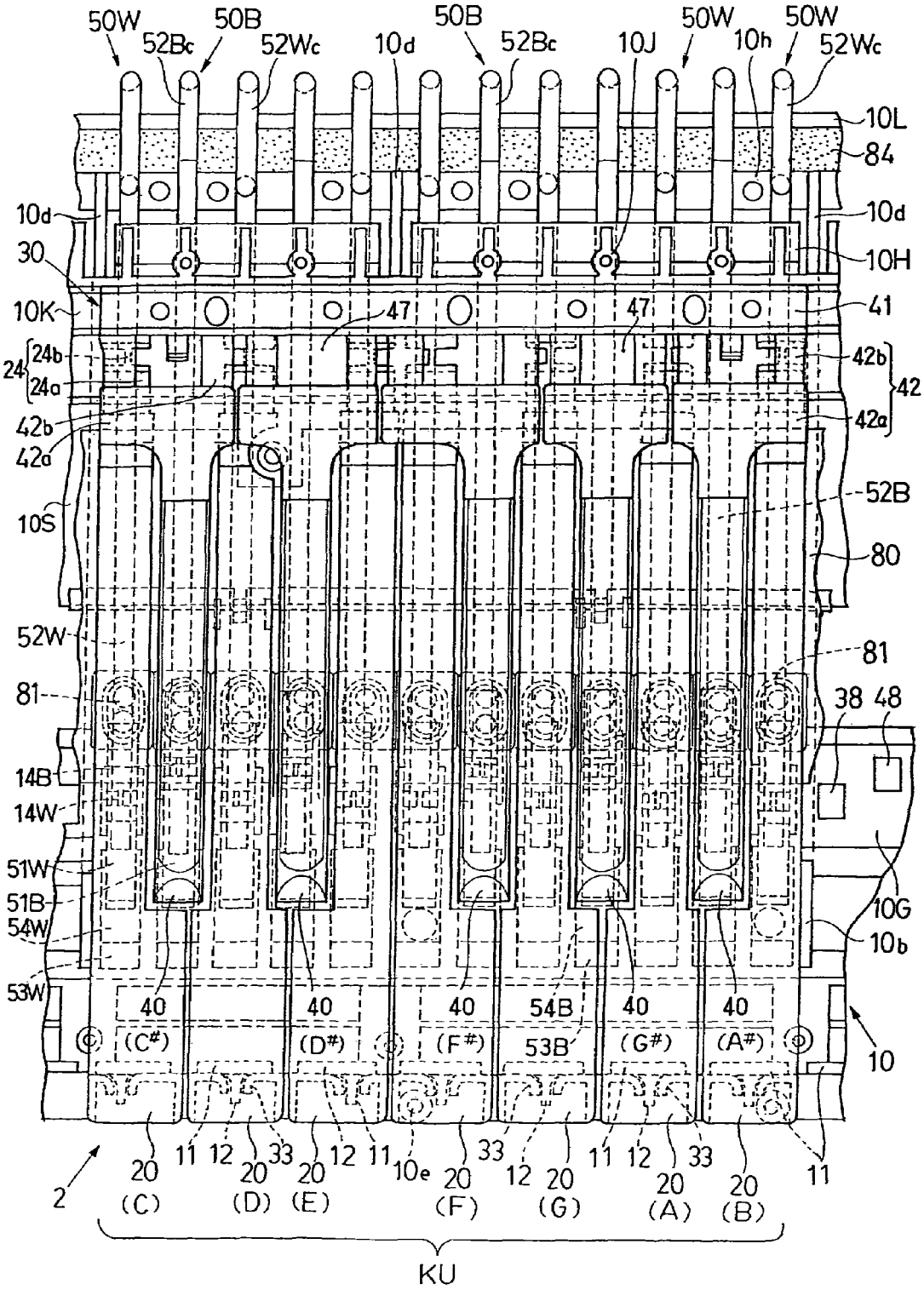
FIG. 2 is a plane view of a one-octave key range portion of the keyboard apparatus.
Figure 3:
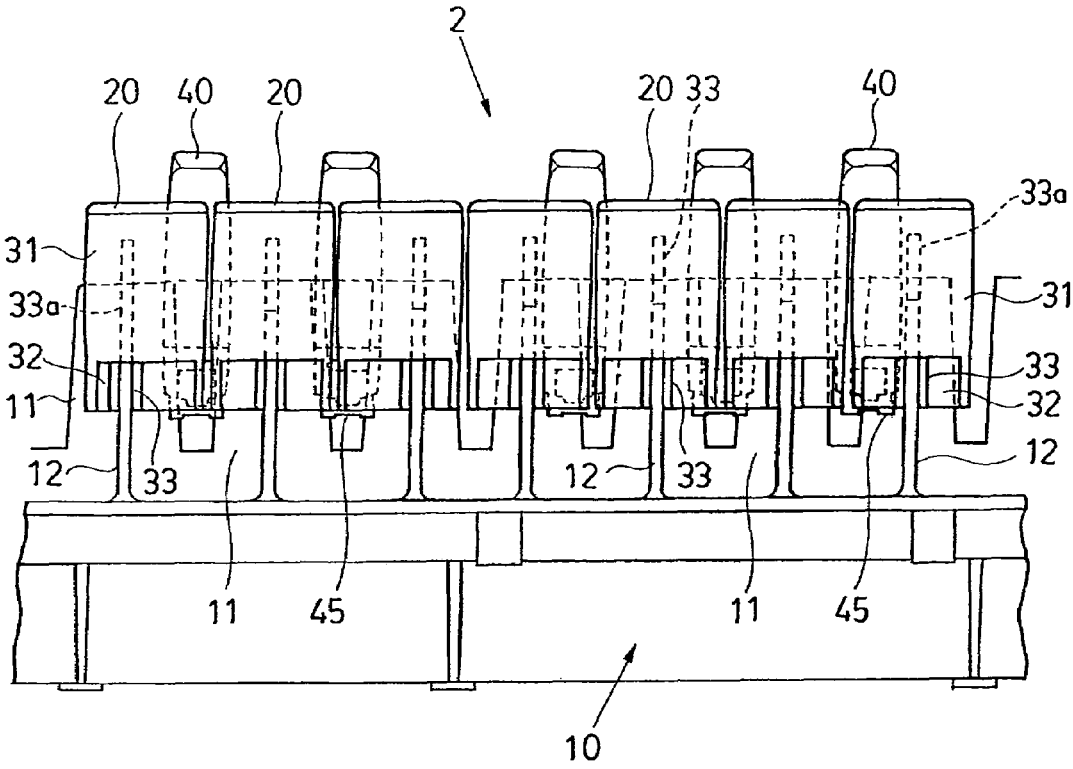
FIG. 3 is a front view of the same.
Figure 4:
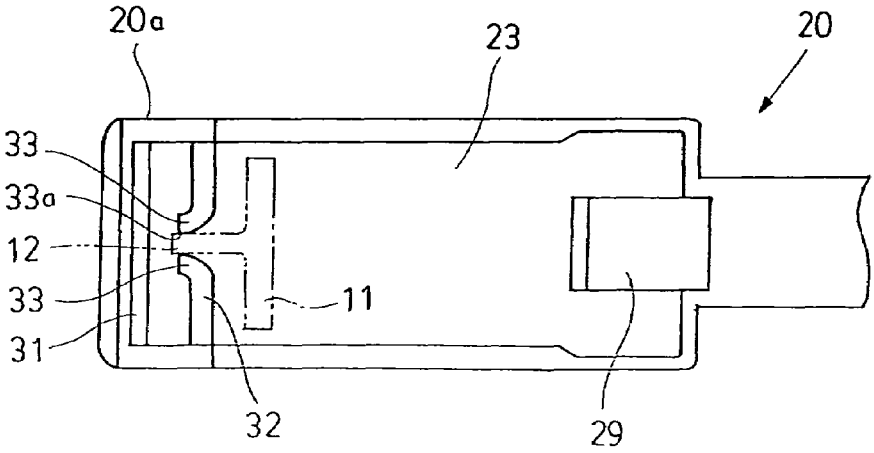
FIG. 4 is a bottom view of a free end side of a white key of the keyboard apparatus.

FIG. 1 to FIG. 10 are views showing one embodiment of the invention. FIG. 1 is a rough cross-sectional view taken along a key longitudinal direction of an electronic musical instrument including a keyboard apparatus according to the invention, FIG. 2 is a plane view of a one-octave key range portion of the keyboard apparatus, FIG. 3 is a front view seen from an arrow S direction in FIG. 1, and FIG. 4 is a bottom view of a free end side of a white key.

Figure 5:
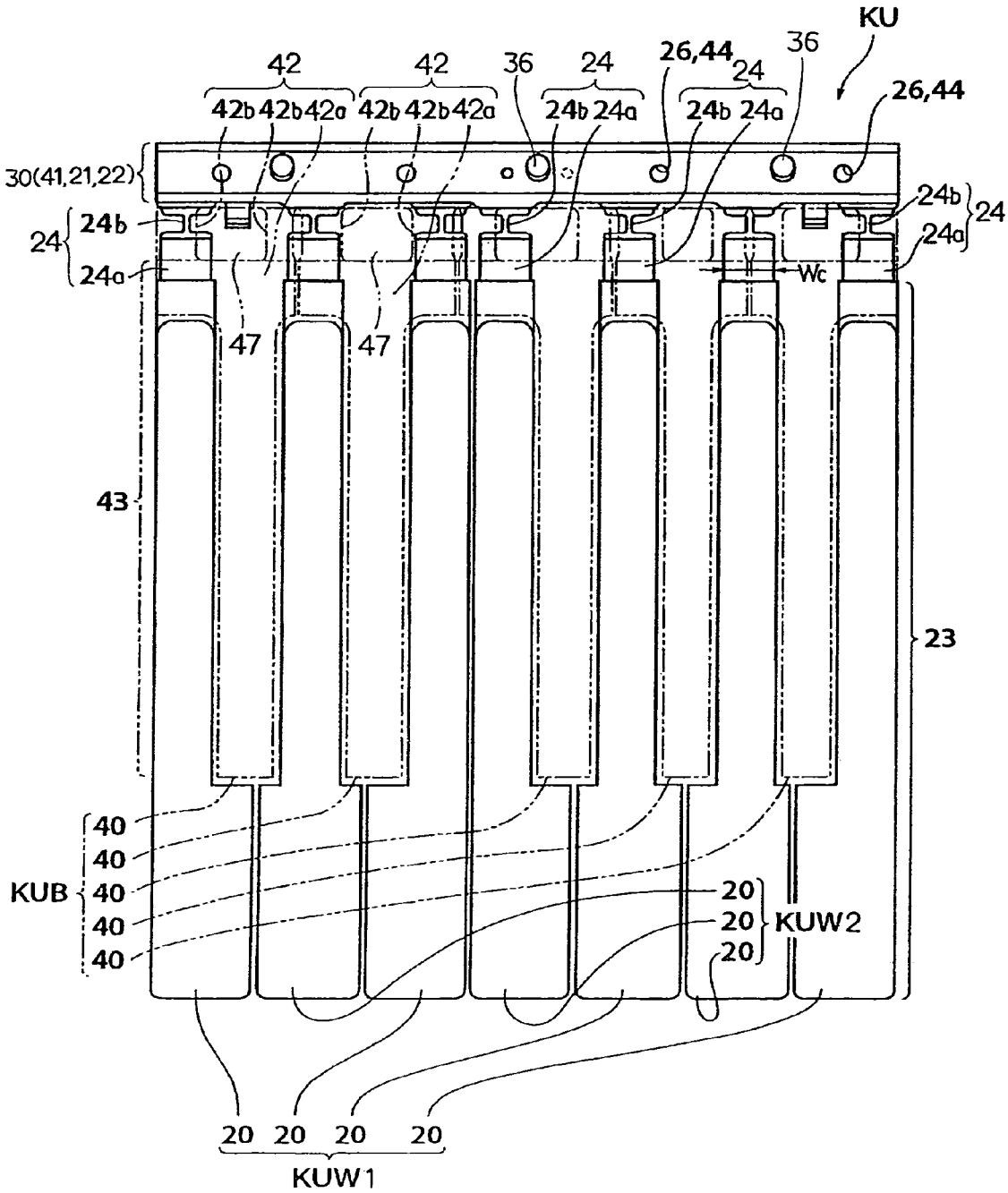
FIG. 5 is a plane view showing only a key unit of the keyboard apparatus, white key units thereof being shown by the solid line and a black key unit thereof being shown by the virtual line.
Figure 6:
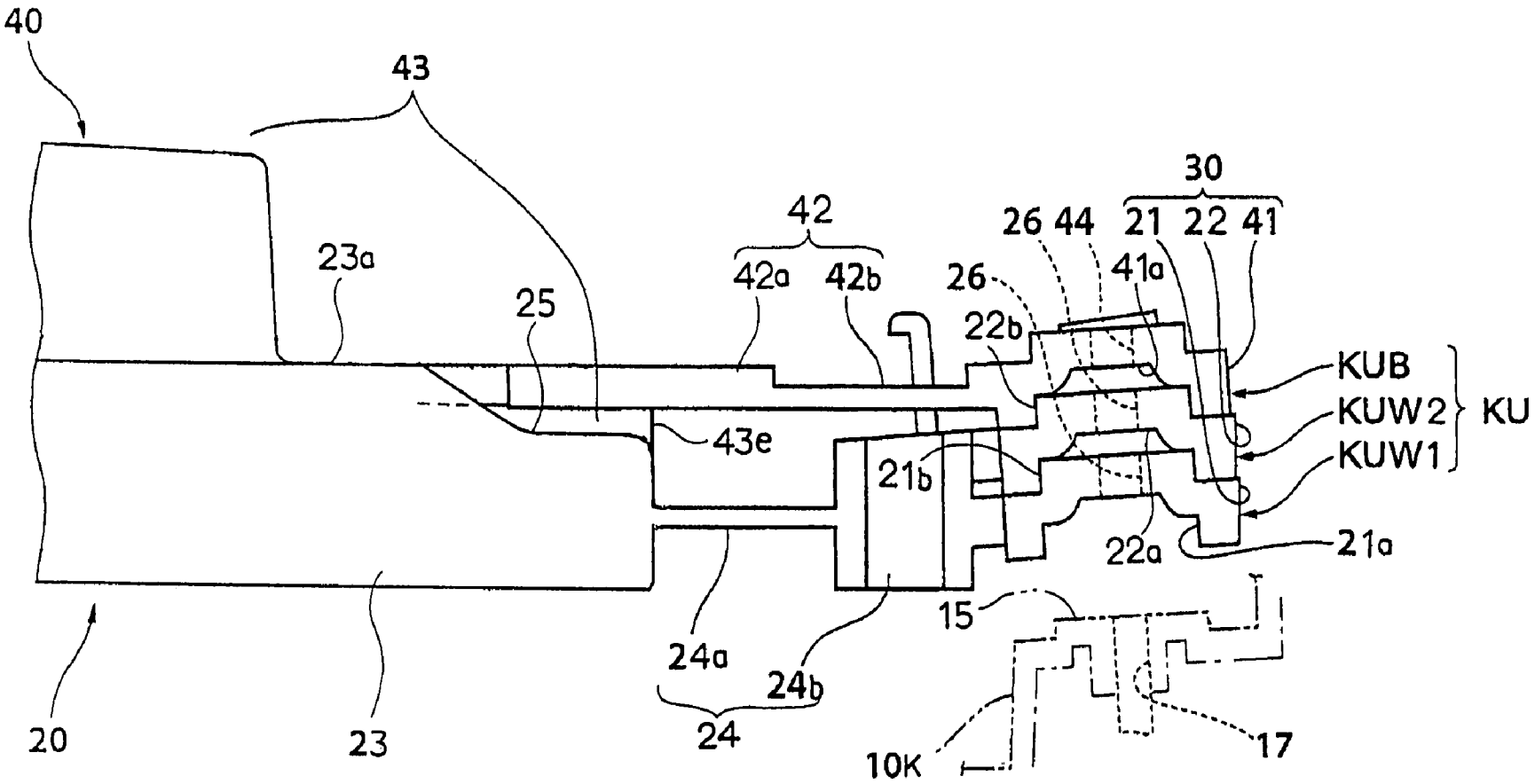
FIG. 6 is an enlarged side view of the vicinity of a common key support part of the key unit.
Figure 7:
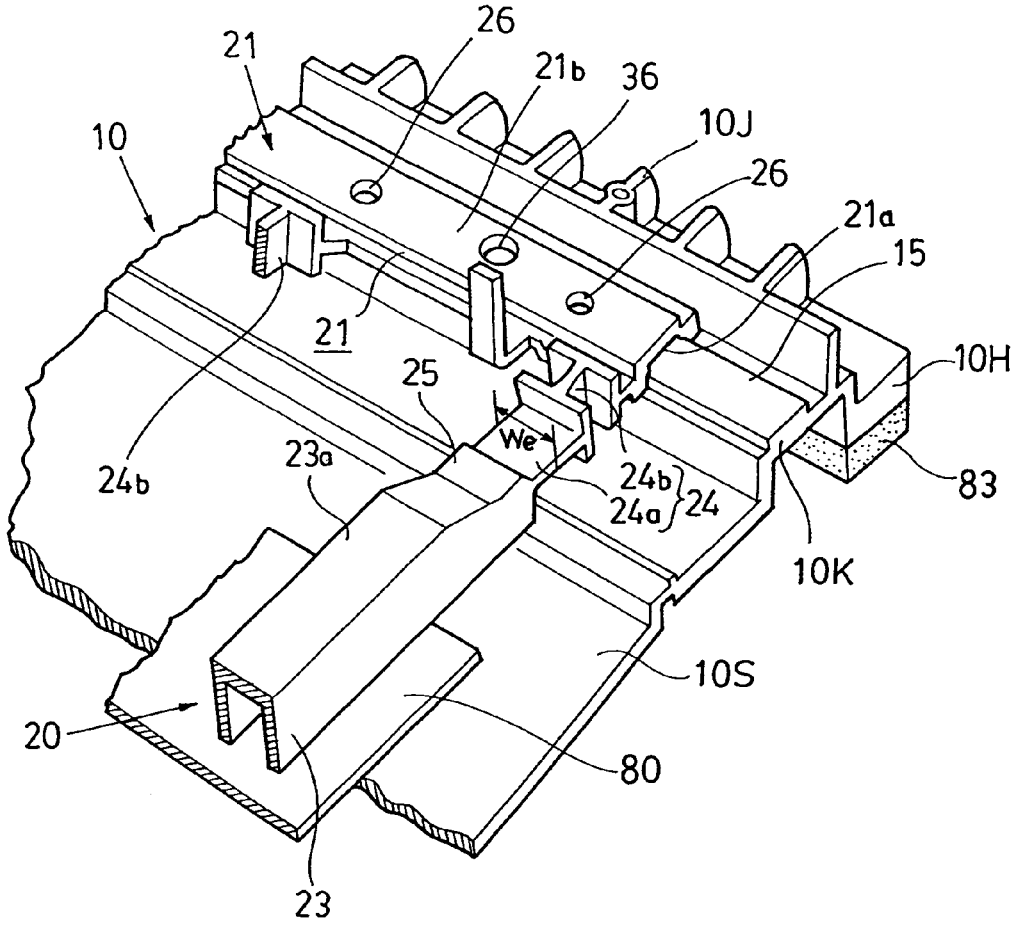
FIG. 7 is a perspective view showing the vicinity of a key mounting part of a keyboard frame of the keyboard apparatus and part of a first white key unit mounted thereon.
Figure 8:
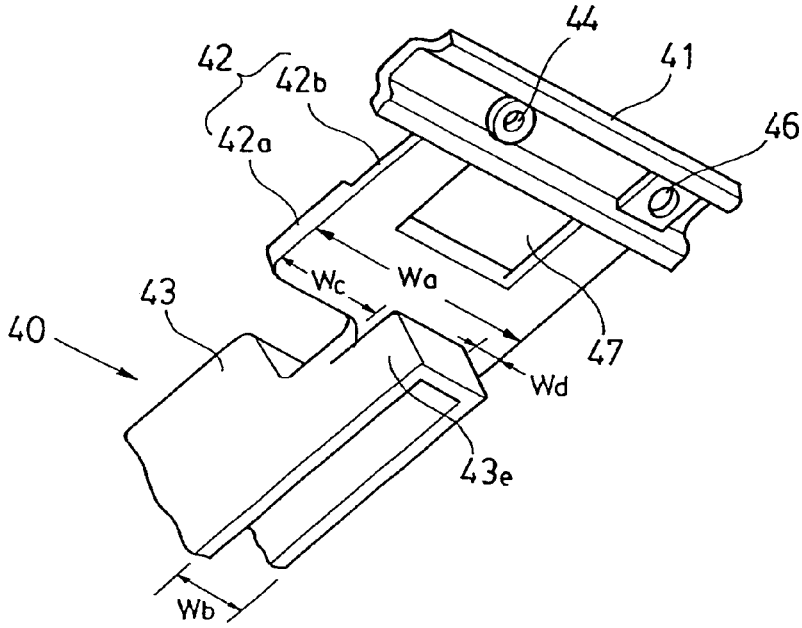
FIG. 8 is a perspective view of part of the black key unit seen from under.

FIG. 5 is a plane view showing only a key unit constituting the keyboard apparatus, white key units thereof being shown by the solid line and a black key unit thereof being shown by the virtual line. FIG. 6 is an enlarged side view showing the vicinity of a common key support part of the key unit, FIG. 7 is a perspective view showing the vicinity of a key mounting part of a keyboard frame being a support member and part of a first white key unit mounted thereon, and FIG. 8 is a perspective view of part of a black key unit seen from under.

Figure 9:
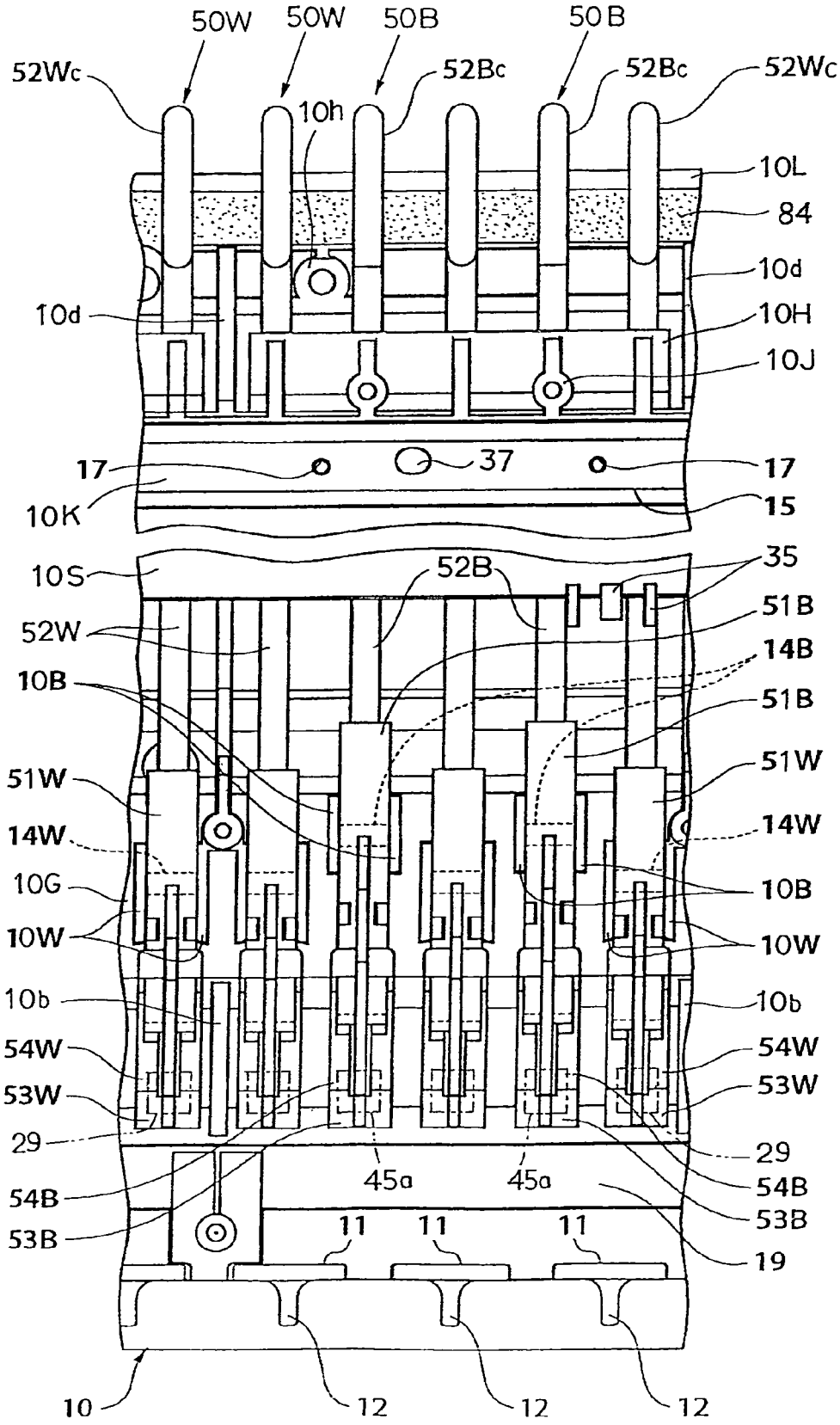
FIG. 9 is a plane view of the keyboard apparatus shown in FIG. 2, partly in cutaway, with the key units and a switch board removed.
Figure 10:
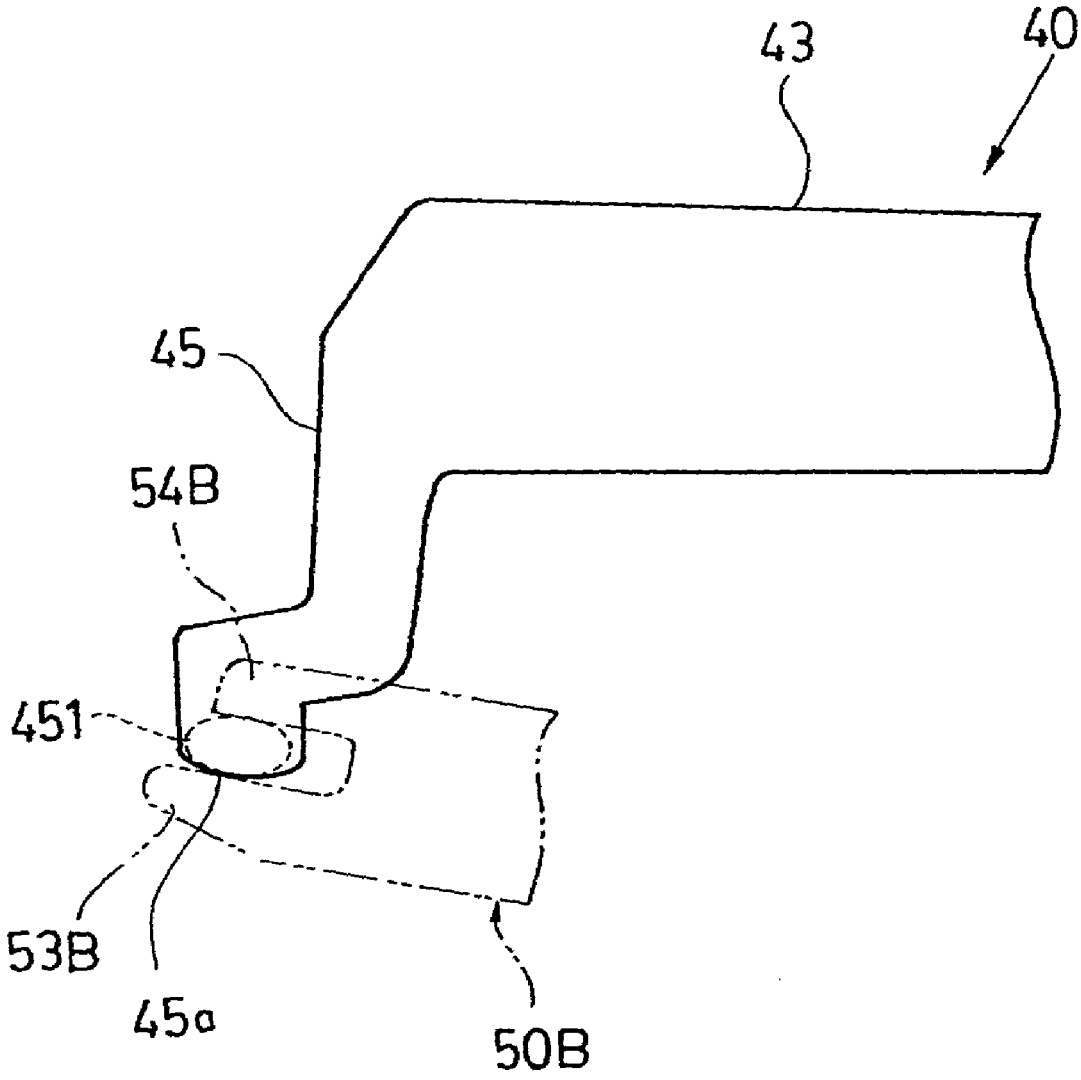
FIG. 10 is a side view of a mass member driving part of a black key.

FIG. 9 is a plane view of the keyboard apparatus shown in FIG. 2, partly in cutaway, with the key units and a switch board removed, and FIG. 10 is a side view of a mass member driving part of a black key.

First, the configuration of the electronic musical instrument shown in FIG. 1 will be mainly described. This electronic musical instrument 1 is an electronic keyboard instrument such as a desktop electronic organ, electronic piano, or synthesizer, and includes a keyboard apparatus 2, an upper case 60, a lower case 70, and electronic circuit parts, a speaker, and so on, which are not shown.

The keyboard apparatus 2 is structured such that many white keys 20 and black keys 40 are mounted on a key mounting part 10K of a keyboard frame 10 being a support member, and is housed in a case composed of the upper case 60 and the lower case 70, with only key main bodies to which a key depression operation is performed being exposed. The upper case 60 and the lower case 70 are engaged with each other, and are fastened to the keyboard frame 10 being a keyboard support member with setscrews 71 and a plurality of not-shown setscrews to be coupled to each other.

The upper case 60 has a key slip 64 on its front face and also has on an upper face of its rear portion a music stand mounting groove 61 in which a music stand 62 is inserted for mounting. Rubber legs 76 are attached to four corners of a bottom face of the lower case 70.

The white keys 20 and the black keys 40 in one octave key range compose one set of a key unit KU as shown in, for example, FIG. 5. The key unit KU is composed of a first white key unit KUW1, a second white key unit KUW2, and a black key unit KUB.

The first white key unit KUW1 includes four white keys 20 being whole tone keys (keys C, E, G, B shown in FIG. 2) which are every other keys from an outer side of one octave, and key main bodies 23 of these white keys 20 are coupled to a common key support part 21 via respective coupling parts 24 to be pivotable in a key depression/release direction.

The second white key unit KUW2 includes the other three white keys 20 being whole tone keys (keys D, F, A shown in FIG. 2) which are every other keys, and key main bodies 23 of these white keys 20 are coupled to a common key support part 22 via respective coupling parts 24 to be pivotable in the key depression/release direction.

The black key unit KUB includes black keys 40 (keys C#, D#, F#, G#, A# shown by the solid line in FIG. 2) shown by the virtual line in FIG. 5 which are five half-tone keys, and key main bodies 43 thereof are coupled to a common key support part 41 via respective coupling parts 42 to be pivotable in the key depression/release direction.

In FIG. 5, reference numeral 23, 43 denote the key main bodies of the white keys 20 and the black keys 40 respectively, and needless to say, the key main bodies 23 of the white keys 20 (hereinafter, referred to as "white key main bodies") are longer in the longitudinal length than the key main bodies 43 of the black keys 40 (hereinafter, referred to as "black key main bodies").

Here, "white keys" and "black keys" do not necessarily mean "keys in white color" and "keys in black color", but for convenience sake, as described above, "white keys" refer to keys whose key main bodies have flat upper faces and longer length and which produce whole tones when depressed, and "black keys" refer to keys whose key main bodies bulge upward from the white keys and have shorter length and which produce half tones when depressed. Therefore, even in a case where black and white colors are reversed in actual keys, keys having the shape and function corresponding to the above-described white keys are called "white keys" and keys having the shape and function corresponding to the above-described black keys are called "black keys".

The respective common key support parts 21, 22, 41 of the first white key unit KUW1, the second white key unit KUW2, and the black key unit KUB are stacked to form a common key support part 30 as shown also in FIG. 6. The common key support part 30 is formed by integrating the common key support parts 21, 22, 41 in such a manner that a fitting recessed groove 22*a* formed in the common key support part 22 of the second white key unit KUW2 is fitted in alignment to a fitting protrusion 21*b* in a rail shape formed in the common key support part 21 of the first white key unit KUW1, and a fitting recessed groove 41*a* formed in the common key support part 41 of the black key unit KUB is fitted in alignment to a fitting protrusion 22*b* in a rail shape formed in the common key support part 22.

Further, a fitting recessed groove 21*a* formed in the common key support part 21 of the first white key unit KUW1 is fitted in alignment to a fitting protrusion 15 in a rail shape formed in a key mounting part 10K of the keyboard frame 10. Then, key unit assembly screws 82 shown in FIG. 1 are inserted for assembly from above in mounting holes 26, 26, 44 of the common key support parts 21, 22, 41 forming the common key support part 30 to be screwed in common key support part mounting screw holes 17 of the key mounting part 10K shown in FIG. 6, so that the common key support parts 21, 22, 41 are commonly fixed to the key mounting part 10K.

In this manner, the first white key unit KUW1, the second white key unit KUW2, and the black key unit KUB are assembled on the keyboard frame 10 as the key unit KU corresponding to one octave as shown in FIG. 2. The necessary number of the key units KU corresponding to the necessary key range are continuously arranged in a key arrangement direction and are assembled, whereby the keyboard apparatus with the necessary number of keys can be structured.

Here, the shapes and so on of the respective coupling parts 24 of the first and second white key units KUW1, KUW2 and the coupling parts 42 of the black key unit KUB will be described in detail with reference to FIG. 2 and FIG. 5 to FIG. 8.

The coupling part 42 via which each of the black key main bodies 43 of the black key unit KUB is coupled to the common key support part 41 to be pivotable in the key depression direction is made wide, with its total width Wa in the key arrangement direction being wider than a key width Wb of the black key main body 43, as clearly shown in FIG. 2 and FIG. 8, so that parts Wc, Wd (for Wa, Wb, Wc, Wd, refer to FIG. 8) thereof overlap with the coupling parts 24 of the adjacent white keys 20, and the black key 40 is restricted from yawing in the key width direction by the coupling part 42 when depressed/released.

As clearly shown in FIG. 6 and FIG. 8, each of the coupling parts 42 of the black keys 40 is composed of a thin hinge part 42*b* allowing the key to pivot at the time of key depression/release and a thick connecting part 42*a* higher in rigidity than the thin hinge part 42*b*. The thick connecting part 42*a* extends backward from a rear end portion 43*e* (FIG. 8) of the black key main body 43, with both sides thereof protruding from both side faces of the rear end portion 43*e* in the adjacent key directions respectively and is connected to the thin hinge part 42*b* and is further coupled to the common key support part 41 via the thin hinge part. The thin hinge part 42*b* has an opening 47 in its key widthwise middle portion and is divided by the opening 47 into right and left portions, as clearly shown in FIG. 2 and FIG. 8.

The thin hinge part 42*b* thus formed functions with the thick connecting part 42*a* to enhance a sectional secondary moment against a key widthwise (lateral direction) force while increasing flexibility in the key depression direction, so that it is possible to fully restrict yawing in the key width direction of the black key main body 43 without using a key guide.

In the coupling part 42, a protrusion amount of the thick connecting part 42*a* from the both side faces of the rear end portion 43*e* of the black key main body 43 differs depending on each of the black keys 40 as shown in FIG. 2. The right and left protrusion amounts are not necessarily equal and the width thereof differs depending on each key. In any case, the wide part as the black key coupling part of each black key can have an average width corresponding to 12/5=2.4 keys, and the total width thereof in the key width direction is made as wide as possible, thereby increasing the effect of restricting the yawing in the key width direction of the key main body 43.

On the other hand, as for each of the coupling parts 24 via which the white key main bodies 23 of the first and second white key units KUW1, KUW2 are coupled to the respective common key support parts 21 and 22 to be pivotable in the key depression direction, a total width We in the key arrangement direction of the coupling part 24 is narrower than the aforesaid total width Wa in the key arrangement direction of the coupling part 42 of the black key unit KUB and is substantially equal to the width of a rear end portion of the white key main body 23, as clearly shown in FIG. 5 and FIG. 7.

Each of the coupling parts 24 is composed of a thin horizontal hinge part 24*a* extending in the key width direction and a vertical hinge part 24*b* extending in the thickness direction and along the longitudinal direction of the key as shown also in FIG. 6. The vertical hinge part 24*b* is formed in a shape of the character "H" rotated by 90° when seen from above, as clearly shown in FIG. 5. A front end portion of the thin horizontal hinge part 24*a* is integrally connected to the rear end 43*e* of the white key main body 23, and a rear end portion of the vertical hinge part 24*b* is integrally connected to the common key support part 21 or 22.

The horizontal hinge part 24*a* supports the white key main body 23 so as to allow the white key main body 23 to pivot in the key depression direction, and the vertical hinge part 24*b* supports the white key main body 23 so as to allow the white key main body 23 to pivot in the key width direction. Therefore, the positioning in the key arrangement direction of the front end portions of the white key main bodies 23 and the restriction of yawing thereof are realized by later-described guide parts provided on free end sides of the white keys 20.

The reason why the vertical hinge part 24*b* exists is to prevent the occurrence of stress in the key free end portion at the time of the key depression/release even if contraction error at the time of molding and variation among respective parts during the thermal cooling cause slight variation in positional accuracy of a key guide part 12 and/or a guided part 33, which will be described later, because the keyboard frame 10 and the key unit KU are formed of resin.

As previously described, the coupling part 42 of the black key 40 has the overlapping portions that partly overlap with the coupling parts 24 of the adjacent white keys 20, with its total width in the key width direction being larger than the key width of the rear end of the black key main body 43, as clearly shown in FIG. 2 and FIG. 5.

Further, as parts of the overlapping portions in the coupling part 42, in the thick connecting part 42*a*, protruding in the adjacent key directions from the both side faces of the rear end portion 43*e* of the black key main body 43 overlap with the upper faces of the rear end portions of the key main bodies 23 of the adjacent white keys 20. Also, as shown in FIG. 6 and FIG. 7, the white key main body 23 has in its rear end portion the escape part 25 that is formed by setting the height of an upper face 23*a* of the rear end portion thereof lower than the height of the other portion. When the black key unit KUB is stacked on the first and second white key units KUW1, KUW2 to form the keyboard apparatus, the thick connecting parts 42*a* which are part of the coupling parts 42 of the black keys 40 are fitted in the escape parts 25 of the white key main bodies 23. In this embodiment, owing to this structure, the upper faces 23*a* of the white key main bodies 23 are flush with upper faces of the thick connecting parts 42*a* of the coupling parts 42 of the black keys 40.

With this structure, in a keyboard apparatus in which no guide part needs to be provided for at least the black keys 40, hinge mechanisms by the coupling parts 24, 42 of the white keys 20 and the black keys 40 are all positioned below the upper faces 23*a* of the white key main bodies 23. This prevents an increase in height and yet enhances a scope for mounting design (panel layout and the like) in the vicinity of fulcrums of the keys. Moreover, since pivotal fulcrums of the black keys 40 and the white keys 20 are vertically close to each other, a keyboard apparatus higher in performability and also key operability could be realized. Particularly, an operation for playing the scales (for example, by keys of C, C#, D, D#, E, F, . . . ) becomes easy.

Additionally, it is possible to prevent an increase in height of the keyboard apparatus and yet to increase the thickness of the white key main bodies 23, so that the white key main bodies 23 are prevented from bending when depressed. Further, the key depression becomes close to parallel key depression owing to the increased length of the white key main bodies 23, which enhances performability.

As for the black keys 40, it is possible to secure a sufficient thickness without increasing the height of the thick connecting parts 42*a* of the coupling parts 42, which can enhance rigidity against yawing in the key width direction.

Returning to FIG. 1, the structure of the keyboard frame 10 being a support member and its related parts will now be described.

In FIG. 1, the keyboard frame 10 is composed of a lower front part positioned on a lower left side, a lower rear part positioned on a lower right side, an upper part positioned on an upper side, and rib parts reinforcing and connecting these parts, and these parts are integrally formed of resin.

In the lower front part, formed are guide support parts 11 with which white key guides 12 are integrally formed, a lower limit stopper support part 10F for white keys, a key unit slide face 19, a mass member mounting part 10G boss parts 10*e* to 10*g* for fixing the lower case, and so on. In the lower rear part, a mass member lower limit stopper support part 10L, a boss part 10*h* for fixing the lower case, and so on are provided. Further, in the upper part, a key mounting part 10K, a switch board mounting part 10S, a mass member upper limit stopper support part 10H, an upper component mounting part 10J, and so on are formed.

The key unit slide face 19 is used at the time of the aforesaid mounting of the key unit KU on the keyboard frame 10. Specifically, when the key unit KU is inserted through a gap between the guide support parts 11 and the switch board 80 from a front side of the keyboard frame 10, lower end faces 29*a*, 45*a* of the later-described mass driving parts 29, 45 provided on the white keys 20 and the black keys 40 respectively are brought into contact with and are slid on a slope of the key unit slide face 19, so that fitting parts 291, 451 of the mass member driving parts 29, 45 can be automatically fitted between the main driven parts 53W, 53B and the sub driven parts 54W, 54B of the later-described white key mass members 50W and black key mass members 50B.

Therefor, the top and bottom surfaces of the fitting parts 291, 451 are fitted between the main driven parts 53W, 53B and the sub driven parts 54W, 54B, the power between the keys and the mass members are transmitted in the both direction of key depression/release.

Components such as an operation panel board housed in the upper part of the upper case 60 can be mounted on the upper component mounting part 10J.

Each of the rib parts is composed of: a rib 10*a* under the white key lower limit stopper support part 10F and the key unit slide face 19; a rib 10*b* above the boss part 10*f*; a rib 10*c* on an inner side of the mass member mounting part 10G, and a main rib 10*d* connecting the lower front part, the lower rear part, and the upper part. The plural rib parts (about two per one octave) each composed of these ribs extend along the key longitudinal direction and are arranged at intervals in the key arrangement direction, as shown in FIG. 2.

On an upper face of the white key lower limit stopper support part 10F, a white key lower limit stopper 34 made of a belt-shaped felt material and extending in the key arrangement direction is pasted and held. On an upper face of the mass member lower limit stopper support part 10L, a mass member lower limit stopper 84 made of a belt-shaped felt material and extending in the arrangement direction of the later-described mass members (hammers) 50W, 50B is pasted and held, as shown also in FIG. 2 and FIG. 9. Further, on a lower face of the mass member upper limit stopper support part 10H, a mass member upper limit stopper 83 made of a belt-shaped felt material and extending in the arrangement direction of the mass members 50W, 50B is pasted and held as shown also in FIG. 7.

Here, the guide parts of the white keys will be described with reference to FIG. 2 to FIG. 4.

On an upper portion on a front end side of the keyboard frame 10, the plate-shaped guide support parts 11 are arranged at positions corresponding to the vicinities of the free ends of the respective white keys along the arrangement direction of the white keys 20 as shown in FIG. 2 and FIG. 3. The plate-shaped white key guides 12 are formed vertically to protrude forward from front faces of the respective guide support parts 11. The guide support parts 11 and the white key guides 12 form T-shaped guide members when seen from above or from under as shown in FIG. 2 by the broken line and in FIG. 4 by the virtual line.

In a tip portion 20*a* of the white key main body 23 on the free end side of each of the white keys 20, as shown in FIG. 4 where the bottom view thereof is shown, an outer front end wall 31 is provided in a front end which is a portion seen from outside when the keyboard apparatus 2 is housed in the case. An upper face portion protrudes slightly forward therefrom. An inner front end wall 32 is formed on an inner side of the outer front end wall 31 to have the same height as the entire height of the tip portion 20*a* of the white key main body 23. In a key widthwise middle portion of the inner front end wall 32, a slit 33*a* extending from a lower end along the key height direction is formed and a pair of guided parts 33 bending and protruding forward are formed symmetrically. A gap width of the slit 33*a* of the guided parts 33 is slightly larger than the thickness of the white key guide 12.

At the time of the aforesaid mounting of the key unit KU on the keyboard frame 10, the white key guides 12 are inserted in the slits 33*a* of the guided parts 33 of the respective white keys 20 as shown in FIG. 2 to FIG. 4, thereby positioning the tip portions of the white keys 20 and restricting yawing at the time of the key depression. Incidentally, since the white key main bodies 23 are pivotable in the key width direction owing to the function of the aforesaid vertical hinge parts 24*b* of the coupling parts 24, it is possible to easily align the arrangement positions of the white key main bodies 23 even with a slight manufacturing error or a slight assembly error, which realizes a smooth key depression/release operation. Preferably, the white key guides 12 and the guided parts 33 of the white keys 20 are coated with lubricating grease.

Returning again to FIG. 1, the switch board 80 is hooked by a switch board locking hook 35 to be mounted on the switch board mounting part 10S of the keyboard frame 10. On the switch board 80, many key switches 81 are arranged at positions corresponding to longitudinal middle portions of the white keys 20 and the black keys 40, as shown also in FIG. 2 by the broken lines.

Each of the key switches 81 has a dome-shaped movable part made of synthetic rubber. The movable part has a pair of pressed parts (two small circles shown by the broken lines in FIG. 2) and has, on an inner side of the pair of the pressed parts, a pair of movable contacts made of conductive rubber, and the respective movable contacts face two sets of fixed contacts formed on the switch board 80 to constitute a two-contact (two-make) key switch. When the white key 20 or the black key 40 is depressed, the bottom face thereof presses the movable part, so that the pair of movable contacts sequentially touch the two sets of fixed contacts to turn ON the contacts, and accordingly, a key depression signal is outputted. Further, from a time difference between the timings at which the contacts turn ON, a key depression speed can be detected, and musical sound to be generated can be controlled according to the detected key depression speed.

Next, since the keyboard apparatus 2 includes the mass members (generally called hammers) operating in linkage with the respective keys so as to provide a heavy touch feeling when the keys are depressed, the mass members will be described with reference to FIG. 2, FIG. 9 and FIG. 10 in addition to FIG. 1.

The white key mass member 50W for the each of white keys 20 and the black key mass member 50B for the each of black keys 40 are mounted respectively on the mass member mounting part 10G of the keyboard frame 10 to be pivotable in the arrow M direction in FIG. 1.

The white key mass members 50W and the black key mass members 50B have substantially the same structure as follows. In each of them, a pivot supported part 51W or 51B, the main driven part 53W or 53B, and the sub driven part 54W or 54B are integrally formed of resin to constitute a driving force transmitting part. A front end portion of an inertia moment generating part 52W or 52B made of a bar-shaped metal material such as an iron material is integrated with the pivot supported part 51W or 51B by outsert molding.

By a bending process, each rear end portion of the inertia moment generating part 52W or 52B is bent upward substantially at a right angle and further bent substantially at a right angle so as to return forward. The rear end portion of the inertia moment generating part 52B of the black key mass member 50B forms a C-shaped mass concentration part 52Bc. The rear end portion of the inertia moment generating part 52W of the white key mass member 50W is further bent downward substantially at a right angle to form a mass concentration part 52Wc in a substantially rectangular loop shape.

The mass concentration parts 52Wc and 52Bc extend more outward (backward) in the key longitudinal direction than the mass member upper limit stopper support part 10H of the keyboard frame 10, and at the highest lifted positions, that is, when the inertial moment generating parts 52W, 52B abut on the mass member upper limit stopper 83, upper faces thereof become substantially flush with the upper faces of the key main bodies 43 of the white keys 20 or the upper faces of the thick connecting parts 42*a* of the black keys 40. Portions in front of the mass concentration parts 52Wc, 52Bc in the inertia moment generating parts 52W, 52B are connecting parts connecting the mass concentration parts 52Wc, 52Bc to the driving force transmitting parts.

In the pivot supported parts 51W, 51B of the respective mass members 50W, 50B, provided are bearing parts 13W, 13B forming recessions in a radial direction and having guide tongue pieces Q which protrude backward from lower sides of the recessions. As shown also in FIG. 9, on an upper face of the mass member mounting part 10G of the keyboard frame 10, pairs of support ribs 10W and pairs of support ribs 10B parallel to the key longitudinal direction are integrally provided, the support ribs 10W or 10B in each pair facing at a predetermined interval in the key width direction, and each of pivotal shafts 14W, 14B is bridged between the pair of support ribs. As shown in FIG. 2, openings 38, 48 are formed in the mass member mounting part 10G to allow mold dies to be put therein when the pivot shafts 14W, 14B are molded. In FIG. 1, the front-side support ribs of the pairs of support ribs 10W are omitted.

The pivot shafts 14W, 14B are inserted in the recessions of the bearings 13W, 13B of the respective mass members 50W, 50B, so that the white key mass members 50W are pivotably supported by the mass member mounting part 10G via the bearing parts 13W, the pivot shafts 14W and the pairs of support ribs 10W, and the black key mass members 50B are pivotably supported by the mass member mounting part 10G via the bearing parts 13B, the pivot shafts 14B and the pairs of support ribs 10B.

The pivot support position, namely, the position of the pivot shafts 14W in terms of the key longitudinal direction is different from that of the pivot shafts 14B as is seen from FIG. 2 and FIG. 9, and the pivot shafts 14W for the white key mass members 50W are positioned closer to a front end than the pivot shafts 14B for the black key mass members 50B.

As shown in FIG. 1, in front end portions of the white key mass members 50W, the main driven parts 53W and the sub driven parts 54W are provided at an interval in the vertical direction to be integrated with the pivot supported parts 51W, and the main driven parts 53W protrude more forward than the sub driven parts 54W. Further, as shown in FIG. 1, the mass driving parts 29 are provided on the lower faces near the rear end portions of wide portions shown in FIG. 4 of the each of white keys 20 to protrude straight downward. Lower end faces of the mass member driving parts 29 abut on upper faces of the main driven parts 53W of the corresponding white key mass members 50W. Further, lower portions of the mass member driving parts 29 are hollow with rear faces thereof being open, and front end portions of the sub driven parts 54W are loosely inserted in the hollow portions as shown by the broken line in FIG. 1.

With the above-described structure, a heavy touch feeling is given when the white key 20 is depressed, because the mass member driving part 29 goes down to drive the main driven part 53W, so that the white key mass member 50W pivots on the pivot shaft 14W serving as a fulcrum, counter-clockwise in FIG. 1 up to the position shown by the virtual line, at which time a part C of the inertia moment generating part 52W abuts on the mass member upper limit stopper 83. When the key release, a lower end inner wall of the mass member driving part 29 is engaged with and lifts the sub driven part 54W, so that the white key mass member 50W pivots clockwise in FIG. 1 on the pivot shaft 14W serving as a fulcrum to quickly return to the position shown by the solid line, at which time the mass concentration part 52Wc abuts on the mass member lower limit stopper 84.

In this manner, the mass member driving parts 29 are engaged with the main driven parts 53W and the sub driven parts 54W of the white key mass members 50W so that the white keys 20 and the white key mass members 50W always operate in linkage each other to pivot.

Similarly, in a front end portion of each of the black key mass members 50B, the main driven part 53B and the sub driven part 54B shown by the virtual lines in FIG. 10 are provided at an interval in the vertical direction to be integrated with the pivot supported part 51B (see FIG. 9), and the main driven part 53B protrudes more to the front side than the sub driven part 54B. Further, as shown in FIG. 10, on a bottom face of a front end portion of each of the black keys 40, the mass member driving part 45 is protrudingly provided. The mass member driving part 45 is cranked downward, forward, and downward to have its lower end face 45*a* abut on an upper face of the main driven part 53B of the corresponding black key mass member 50B, and the position in the key longitudinal direction of the mass member driving part 45 is aligned with the position where the lower end face of the white key mass member driving part 29 abuts on the main driven part 53W of the white key mass member 50W, as shown by the virtual line in FIG. 9.

A lower end portion 45*a* of the mass member driving part 45 is also hollow, with a rear face thereof open, and a front end portion of the sub driven part 54B is loosely inserted therein as shown by the virtual line in FIG. 10.

Consequently, similarly to the above-described case of the white keys 20 and the white key mass members 50W, the black keys 40 and the black key mass members 50B also always operate in linkage each other when pivoting.

In this embodiment, the mass member driving parts 45 extend forward under the white keys 20 as described above, so that the driving positions in the key longitudinal direction of the white key mass members 50W and the black key mass members 50B by the mass member driving parts 29, 45 of the white keys 20 and the black keys 40 become substantially the same. On the other hand, the positions in the key longitudinal direction of the pivot shafts 14W and 14B serving as pivotal fulcrums of the white key mass members 50W and the black key mass members 50B are different (they are staggered arrangement).

Therefore, the distance from points where the black key mass members 50B are driven by the mass member driving parts 45 to the pivotal fulcrums are longer than the distance from points where the white key mass members 50W are driven by the mass member driving parts 29 to the pivotal fulcrums, and the distance from the pivotal fulcrums of the inertia moment generating parts 52B of the black key mass members 50B to the parts C abutting on the mass member upper limit stopper 83 is shorter than the distance from the pivotal fulcrums of the inertia moment generating parts 52W of the white key mass members 50W to the parts C abutting on the mass member upper limit stopper 83. This realizes good balance between the white keys 20 and the black keys 40 in terms of key depression feeling.

The following description will be on reasons why the white key mass members 50W and the black key mass members 50B in this embodiment are structured, as described above, such that the mass concentration parts 52Wc and 52Bc extend more outward (backward) in the key longitudinal direction than the mass member upper limit stopper support part 10H of the keyboard frame 10, and at the highest lifted position, namely, when the inertia moment generating parts 52W, 52B abut on the mass member upper limit stoppers 83, the upper faces thereof become substantially flush with the upper faces of the key main bodies 43 of the white keys 20 or with the upper faces of the thick connecting parts 42*a* of the black keys 40.

In a piano system keyboard apparatus with mass members (hammers), balancing with a mounting space is important for realizing a good key depression touch feeling. In particular, a musical instrument in a lower price range has a larger dimensional restriction of an instrument main body and thus involves a higher possibility that performance as a keyboard has to be sacrificed, and therefore, achieving the highest possible space efficiency under such a restriction is essential. Arranging the minimum necessary members and other functional components at the same height can eliminate an excessive space. What is especially important is that a movement amount of the mass members (hammers) almost determines the height of a unit.

Therefore, by making the mass concentration parts of the mass members extend more outward in the key longitudinal direction than the mass member upper limit stopper support part of the keyboard frame, it is possible to realize both improved equivalent mass and reduced weight of the mass members as well as resulting cost reduction.

Feeling of mass is proportional to a square of the distance from a pivotal fulcrum to a gravity center of a mass member, and therefore, the mass concentration part is preferably positioned as far as possible from the pivotal fulcrum. For this purpose, the mass concentration parts are made to protrude from the keyboard frame, and further upper ends of the mass concentration parts are positioned at the same height as the highest point of the keyboard frame and the keys when the mass members pivot upward. This makes it possible both to improve a touch feeling and to secure the scope for mounting at a higher level.

Further, in this embodiment, the mass concentration parts 52Wc, 52Bc of the mass members 50W, 50B are made of the bar-shaped metal members whose rear end portions are bent upward in the key depression/release direction and further bent toward the connection parts. This structure makes it possible to increase an inertia moment by increasing equivalent weight without making the whole length of the mass members 50W, 50B very long, leading to an improved touch feeling. In addition, since each of the mass concentration parts 52Wc, 52Bc is bent in a space having a width equal to the diameter of the bar-shaped metal member and parallel to the key depression/release direction, it is possible to avoid interference with the mass members of the adjacent keys and make efficient use of an upper space.

This bent shape of the mass concentration parts 52Wc, 52Bc is not limited to a C-shape or a rectangular shape but may be various shapes such as a U-shape, a triangular shape, a circular shape, and a spiral shape.

Further, in this embodiment, the mass concentration parts 52Wc, 52Bc of the white key mass members 50W and the black key mass members 50B are different in effective length (length when they are stretched=weight), so that the white keys 20 and the black keys 40 are equal in touch feeling.

Further, in the keyboard apparatus 2 of this embodiment, the components of the keyboard frame 10 are supported by the many ribs to be integrated as described in FIG. 1. Each of the largest ribs 10*d* among these ribs is provided between predetermined two adjacent mass members among the plural mass members 50W, 50B to be parallel to the longitudinal direction thereof. At least part of lower edges of the ribs 10*d* (middle portions along the key longitudinal direction of the ribs 10*d* in the example in FIG. 1) are formed along lower edges of the mass members 50W, 50B when the mass members 50W, 50B are not driven and are in an inclined state with the mass concentration parts 52Wc, 52Bc being at the lowest descended position as shown by the solid line. This structure enables effective use of a space formed in a lower part of the keyboard frame 10. For example, functional components and so on that are long in the arrangement direction of the keys and the mass members (key width direction) can be easily disposed.

In this case, the pivotal fulcrum portions by the bearing parts 13W, 13B of the mass members 50W, 50B and by the pivot shafts 14W, 14B on the mass member mounting part 10G side are provided at a predeteremined height position from the lowest end of the keyboard frame 10 being the support member, whereby a space outside the movement range of the mass members 50W, 50B is formed under the mass members 50W, 50B, and the highest part of the space coincides with the lower edges of the ribs 10*d*.

Moreover, a plurality of recessed portions 16, 18 recessed into this space are formed in the lower case 70 mounted on the lower end of the keyboard frame 10, and the respective recessed portions 16, 18 can serve as functional component housing parts. In the example shown in FIG. 1, the recessed portion 18 is used as a battery chamber storing batteries or a battery pack, and a cover 75 is detachably provided therein.

With this structure, in a case of a portable electronic keyboard instrument, it is possible to put necessary batteries or a necessary battery pack containing batteries without providing extra space (without increasing the dimension in the height direction of the keyboard apparatus).

The other recessed portion 16 is used as a functional component housing part and various kinds of functional components that are long in the key arrangement direction can be stored therein. This functional component housing part can also be used as a part in which a temporary support member used when the keyboard frame 10 is fitted in the lower case 70 is inserted or as a part for storing accessories such as cords and microphones.

As the functional components, bending-preventive rigidity generating members (ribs, reinforcing members, and the like extending in the key arrangement direction) for increasing rigidity in the key arrangement direction of the keyboard apparatus also can be disposed under the lower edges of the ribs.

The lower case 70 is fixed to the boss parts 10*f*, 10*g*, 10*h* of the keyboard frame 10 with setscrews 72, 73, 74.

It is also possible to integrate the keyboard frame 10 and the lower case 70 and make part of the lower case support the key unit and the mass members.

In this embodiment, only dispersed two or three places of the bottom face of the keyboard frame 10 constitute the lowest end of the keyboard frame 10 being the support member. In the example shown in FIG. 1, only the bottom faces of the boss parts 10*f*, 10*h* constitute the lowest end of the keyboard frame 10 and the other portions are higher than the lowest end. For example, a bottom face of the boss part 10*g* is slightly higher than the bottom face of the boss part 10*f*. When two places constitute the lowest end, at least one of them needs to have a certain length to produce a state similar to three-point support.

With this structure, the keyboard apparatus 2 does not wobble and can be stably set when it is directly placed on a key bed of a keyboard instrument without mounting the lower case 70.

Figure 11:
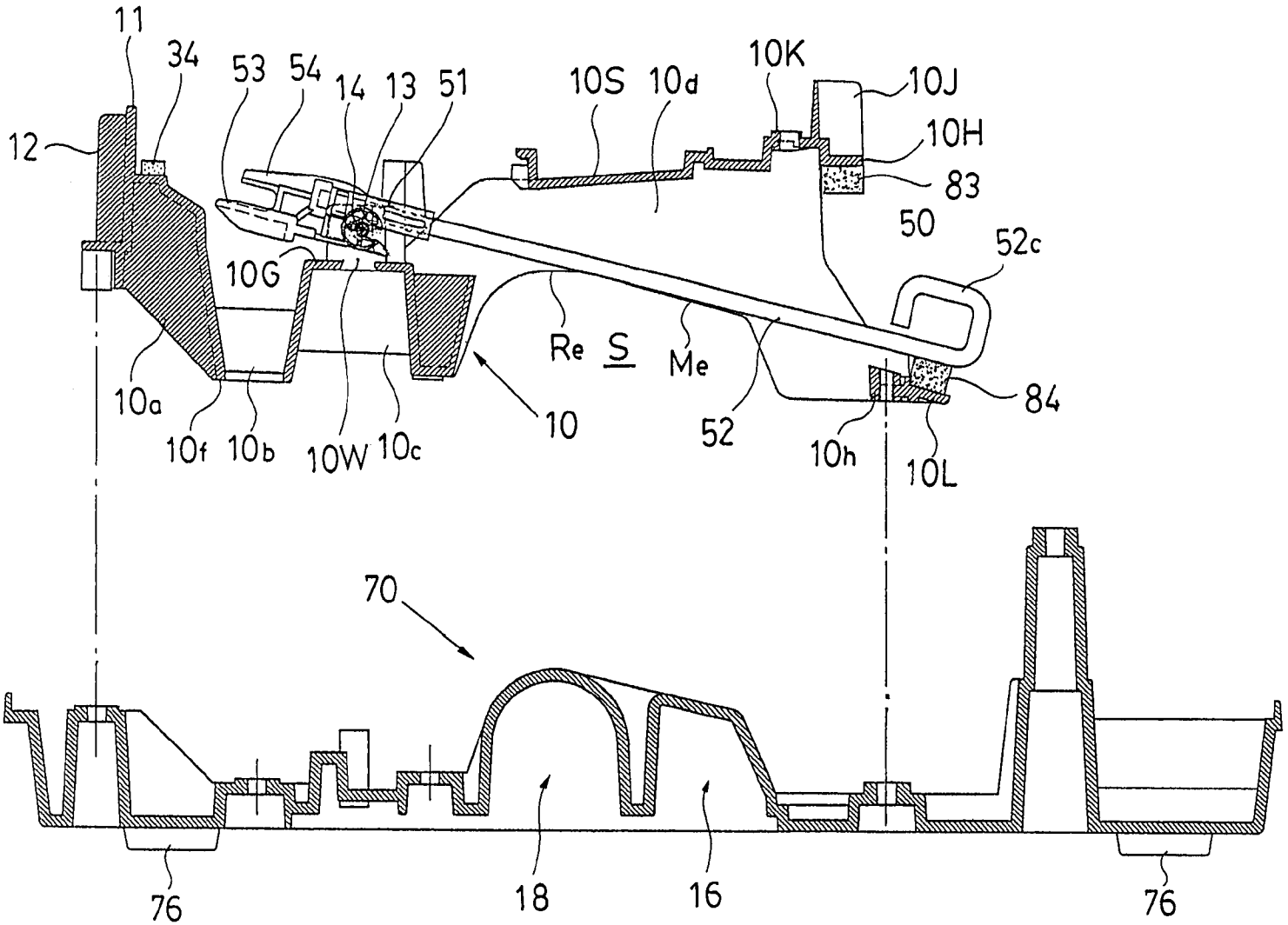
FIG. 11 is a separated sectional view of the keyboard frame on which a mass member shown in FIG. 1 is mounted and a lower case.

Here, the relation between the shape of the ribs of the keyboard frame and the lower case in the keyboard apparatus shown in FIG. 1 will be described with reference to FIG. 11 in an easy-to-understand way. FIG. 11 shows a cross section taken along a different position in the key arrangement direction from that in FIG. 1, with the keyboard frame 1 and the lower case 70 being shown in a vertically separated manner. The mass members and the pivot shafts for the white key and the black key are not discriminated by different reference symbols, but "W" and "B" are excluded from the reference numerals used in the above-described drawings to denote them. The same reference symbols as those in FIG. 1 are used to denote the other portions corresponding to those in FIG. 1, and description thereof will be omitted.

The plural mass members 50 are pivotably mounted on the mass member mounting part 10G that is positioned at a predetermined height from the lowest end of the keyboard frame 10 being the support member, with the bearing parts 13 of the pivot supported parts 51 being supported by the pivot shafts 14 provided between the pair of support ribs 10W (the support rib 10W on the near side is removed in FIG. 11) formed in the mass member mounting part 10G. The inertia moment generating parts 52 made of the bar-shaped metal material extend in the longitudinal direction of the not-shown keys and each has the mass concentration part 52*c* in its rear end portion. At the non-driven time when the main driven part 53 and the sub driven part 54 are not driven by the key, the mass member 50 is in an inclined state where the mass concentration part 52*c* is at the lowest descended position as shown in FIG. 11.

The keyboard frame 10 being the support member has the ribs 10*d* each provided between predeteremined two adjacent mass members 50 among the plural mass members 50, and at least part of a lower edge Re of the rib 10*d* is formed along (at the same height as) a lower edge Me of the mass member 50 which is not driven and thus in the inclined state.

The pivot shaft 14 being the pivotal fulcrum part of the mass member 50 is provided between the support ribs 10W on the mass member mounting part 10G that is at the predetermined height position from the lowest end (bottom faces of the boss parts 10*f*, 10*h*) of the keyboard frame 10. Therefore, a space S outside a movement range of the mass members 50 is formed thereunder, and an upper most portion of the space S coincides with part of the lower edges Re of the ribs 10*d*.

The lower case 70 mounted on the lower end of the keyboard frame 10 has the plural recessed portions 16, 18 recessed into the space S to serve as functional component housing parts. For example, the recessed portion 18 can be used as a battery housing part housing batteries or a battery pack and the other recessed portion 16 can be used as an accessory housing part storing accessories such as cords or microphones.

Figure 12:
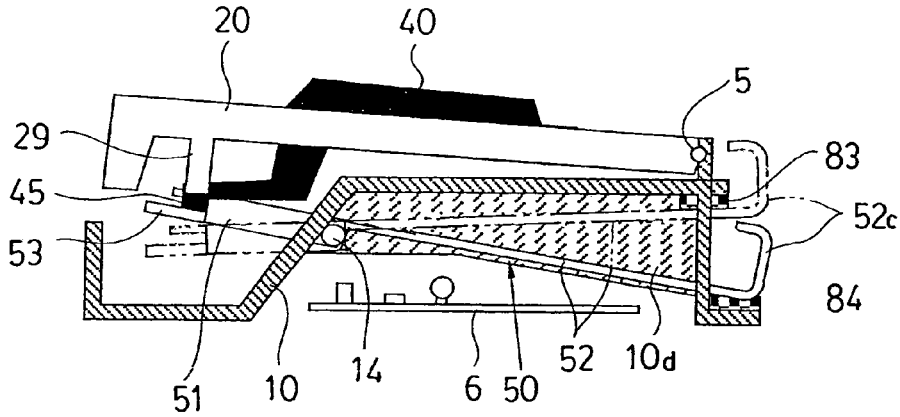
FIG. 12 is a schematic side view showing a usage example of a space under the mass members in the keyboard apparatus according to the invention.
Figure 13:
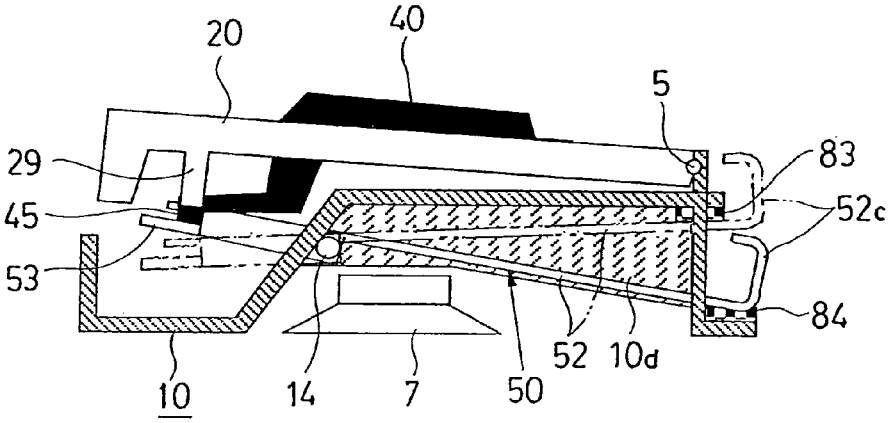
FIG. 13 is a schematic side view showing another usage example of the space under the mass members in the keyboard apparatus according to the invention.

FIG. 12 and FIG. 13 are schematic side views showing other usage examples of the space under the mass members of the keyboard apparatus according to the invention. In these drawings, which show the keyboard apparatus shown in FIG. 1 and FIG. 11 in a simplified manner, the same reference symbols are used to designate components corresponding to those in FIG. 1 and FIG. 11, and description thereof will be omitted. As in FIG. 11, the mass members for the white keys and the black keys are not discriminated by different reference symbols but reference symbols without "W" and "B" are used to denote them. Reference numeral 5 denotes a key pivoting part coupling the white key 20 or the black key 40 pivotably to the keyboard frame 10.

FIG. 12 shows an example where a printed circuit board 6 constituting an electronic circuit such as an amplifier is disposed in the space under the mass members 50, and the printed circuit board 6, even if long in the key arrangement direction, can be easily disposed without any interference by the many ribs 10*d*.

FIG. 13 shows an example where speakers 7 are disposed in the space under the mass members 50, and the plural speakers 7 can be arranged in arbitrary positions in the key arrangement direction. In this case, the keyboard apparatus is applied to a console-type electronic keyboard instrument, and tone emission holes are formed in a key bed of the keyboard instrument so that sound is emitted downward from the key bed.

In any of these cases, the printed circuit board 6 or the speakers 7 do not protrude from the lowest end of the keyboard frame 10. Nor do they interfere with the ascending/descending movement of the inertia moment generating part 52*c* when the mass members 50 pivot.

The invention is applicable not only to electronic keyboard instruments but also to electric keyboard instruments using acoustic sound generators and other keyboard instruments including mass members. It goes without saying that the shapes and arrangements of the components are not limited to those in the embodiment, but may be appropriately changed according to the specifications of musical instruments to which the invention is applied.

The keyboard apparatus according to the invention is applicable to various kinds of keyboard instruments, for example, electronic keyboard instruments such as electronic organs, electronic pianos, and synthesizers, and electric keyboard instruments. In particular, the keyboard apparatus according to the invention is suitably applicable to a small-type electronic keyboard instrument including mass members (hammers) for respective keys, and it is possible to provide a high-performance, compact electronic keyboard instrument with a good key touch feeling at low cost.

What is claimed is:

1. A keyboard apparatus comprising:

a support member;

a plurality of keys pivotably supported on the support member; and a plurality of mass members provided under the respective keys to be pivotably supported on the support member via pivotal fulcrum parts and driven to pivot via mass member driving parts provided under the plural keys respectively, the plurality of mass members forming a space therebelow, said space being outside of the movement range of the mass members, wherein the plural mass members extend along a longitudinal direction of the keys, have mass concentration parts in rear end portions thereof, and are mounted on the support member in such a manner that, when not driven, the mass members are in an inclined state with the mass concentration parts being at a lowest descended position, wherein the space is used for housing a necessary functional component of the keyboard apparatus, and wherein the support member has a rib provided between predetermined two adjacent mass members among the plural mass members and at least part of a lower edge of the rib is formed along lower edges of the mass members that are not driven and are in the inclined state.

2. A keyboard apparatus according to claim 1, wherein the pivotal fulcrum parts of the mass members are provided at a predetermined height position from a lowest end of the support member, whereby the space outside a movement range of the mass members is formed under the mass members, and an uppermost portion of the space coincides with the part of the lower edge of the rib.

3. A keyboard apparatus according to claim 2, wherein a lower case is mounted on the lowest end of the support member, the lower case has a recessed portion recessed into the space, and the recessed portion serves as a functional component housing part.

4. A keyboard apparatus according to claim 2, wherein a printed circuit board is disposed in the space outside the movement range of the mass members.

5. A keyboard apparatus according to claim 2, wherein a speaker is disposed in the space outside the movement range of the mass members.

6. A keyboard apparatus according to claim 3, wherein the recessed portion is a battery housing part storing batteries or a battery pack.

7. A keyboard apparatus according to claim 3, wherein the recessed portion is an accessory housing part storing an accessory such as a cord or a microphone.

* * * * *